US006923640B2

(12) United States Patent
Canon

(10) Patent No.: US 6,923,640 B2
(45) Date of Patent: Aug. 2, 2005

(54) FLAME BURNER IGNITION SYSTEM

(75) Inventor: Daniel Canon, Havre De Grace, MD (US)

(73) Assignee: General Electric Company, Schenectady, NY (US)

( * ) Notice: Subject to any disclaimer, the term of this patent is extended or adjusted under 35 U.S.C. 154(b) by 46 days.

(21) Appl. No.: 09/682,622

(22) Filed: Sep. 28, 2001

(65) Prior Publication Data

US 2003/0064335 A1 Apr. 3, 2003

(51) Int. Cl.[7] ..... F23N 5/12; F23Q 23/00

(52) U.S. Cl. ..... 431/72; 431/24; 431/264; 126/39 BA

(58) Field of Search ..... 431/72, 24, 25, 431/77, 78, 74, 71, 264, 259, 258, 69; 436/154; 324/468; 340/577, 579; 126/39 BA, 39 E

(56) References Cited

U.S. PATENT DOCUMENTS 3,551,083 A * 12/1970 Michaels ..... 431/66
3,836,857 A * 9/1974 Ikegami et al. ..... 340/579
3,920,376 A 11/1975 Wyland ..... 431/79
4,245,978 A * 1/1981 del Valle ..... 431/72
4,404,616 A * 9/1983 Miyanaka et al. ..... 340/579
4,519,771 A 5/1985 Six et al. ..... 431/25
4,552,528 A * 11/1985 Gaiffier ..... 431/25
4,662,838 A 5/1987 Riordan ..... 431/25
5,119,802 A * 6/1992 Cherry et al. ..... 431/264
5,169,303 A 12/1992 Paluck ..... 431/74

FOREIGN PATENT DOCUMENTS

WO WO 81/1605 A1 * 6/1981 ..... F23Q/23/00

* cited by examiner

*Primary Examiner*—Josiah C. Cocks
(74) *Attorney, Agent, or Firm*—H. Neil Houser, Esq.; Armstrong Teasdale LLP

(57) ABSTRACT

An ignition system includes a burner, a power supply, an electrical system including a ground conductor, and an ignition module. The ignition module includes a first input, a second input, and an output. The output is operatively coupled to the burner, while one of the inputs is coupled to said ground conductor, and the other of the inputs is coupled to the power supply.

11 Claims, 4 Drawing Sheets

FLAME BURNER IGNITION SYSTEM

BACKGROUND OF INVENTION

This invention relates generally to a method an apparatus for detecting a burner flame, and, more particularly, to methods and apparatus for igniting a flame of a gas burner.

Some gas-fired cooktops include ignition devices that generate a spark to ignite a burner when applicable fuel valves are opened to deliver fuel to the burner. One type of ignition device also continuously monitors the burner utilizing the rectifying effect of the burner flame and therefore detects the presence of a flame on the burner after ignition. If the flame extinguishes when the fuel valve is opened, the ignition device generates a spark to reignite the burner flame. See for example, U.S. Pat. Nos. 5,619,303 and 4,519,771. The circuitry of the ignition device is sometimes packaged in a module that is electrically connected between a cooktop power supply and the cooktop burner system. Power supply phase conductors and neutral conductors are input to the module, and the module output is fed to an electrode and an igniter for ignition or reignition of the burner flame as necessary.

Known ignition modules for gas-fired burners, however, are susceptible to malfunctions in use. For example, the phase and neutral conductors of an alternating current power supply can sometimes be reversed and cause the modules to continuously spark. In addition, the modules are often sensitive to voltage on the neutral conductor which desensitizes the flame detection circuit and can lead to continuously generated sparks despite the presence of a flame on a burner. Still further, proper operation of the ignition modules is dependent upon proper connection of ground conductors and neutral conductors in electrical junction boxes that feed the ignition module in use. If the electrical junction box is not properly wired, the ignition module will continuously spark. Unnecessary sparking of the ignition module reduces energy efficiency and also shortens a useable life of the ignition module.

SUMMARY OF INVENTION

In one aspect, a method for installing an ignition module for a flame burner to an electrical system is provided. The electrical system includes a phase conductor, a neutral conductor and a ground conductor, and the burner is connected to the ground conductor. The ignition module includes first and second inputs and at least one output. The method comprises connecting the phase conductor to the first input of the ignition module and connecting the ground conductor to the second input of the ignition module.

In another aspect, an ignition system is provided which comprises a burner, a power supply, an electrical system comprising a ground conductor, and an ignition module comprising a first input, a second input, and an output, said output operatively coupled to said burner, one of said inputs coupled to said ground conductor, the other of said inputs coupled to said power supply.

DETAILED DESCRIPTION

While the invention is described in the context of a gas-fired cooktop, as set forth more fully below, it is contemplated that the present invention may find utility in other applications, including but not limited to, gas heater devices, gas ovens, gas kilns, gas-fired meat smoker devices, and gas barbecues. In addition, the principles and teaching set forth herein may find equal applicability to combustion burners for a variety of combustible fuels. The description hereinbelow is therefore set forth only by way of illustration rather than limitation, and any intention to limit practice of the present invention to any particular application is expressly disavowed.

Figure 1:
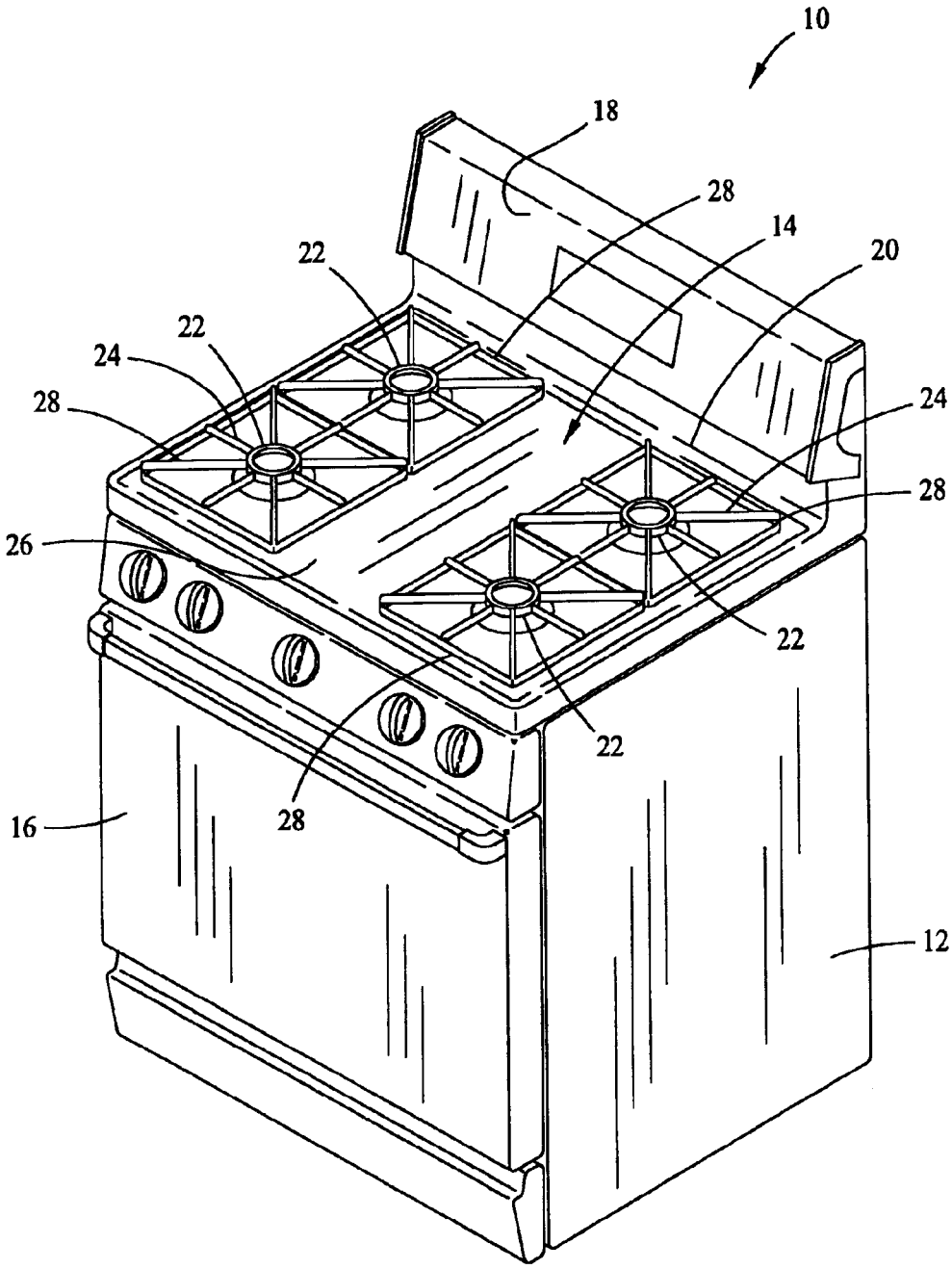
FIG. 1 is perspective view of an oven range.

FIG. 1 illustrates an exemplary free standing gas range 10 in which the present invention may be practiced. Range 10 includes an outer body or cabinet 12 that incorporates a generally rectangular cooktop 14. An oven, not shown, is positioned below cooktop 14 and has a front-opening access door 16. A range backsplash 18 extends upward of a rear edge 20 of cooktop 14 and contains various control selectors (not shown) for selecting operative features of heating elements for cooktop 14 and the oven. It is contemplated that the present invention is applicable, not only to cooktops which form the upper portion of a range, such as range 10, but to other forms of cooktops as well, such as, but not limited to, free standing cooktops that are mounted to kitchen counters. Therefore, gas range 10 is provided by way of illustration rather than limitation, and accordingly there is no intention to limit application of the present invention to any particular appliance or cooktop, such as range 10 or cooktop 14.

Cooktop 14 includes four gas fueled burners 22 which are positioned in spaced apart pairs positioned adjacent each side of cooktop 14. Each pair of burners 22 s surrounded by a recessed area 24 of cooktop 14. Recessed areas 24 are positioned below an upper surface 24 of cooktop 14 and serve to catch any spills from cooking utensils (not shown in FIG. 1) being used with cooktop 14. Each burner 22 extends upwardly through an opening in recessed areas 24, and a grate 28 is positioned over each burner 22. Each grate 28 includes a flat surface thereon for supporting cooking vessels and utensils over burners 22 for cooking of meal preparations placed therein.

The construction and operation of the range heating elements, including cooktop gas burners 22 are believed to be within the purview of those in the art without further discussion, and as details of the range heating elements are generally beyond the scope of the present invention, further description thereof is omitted. Further, it is contemplated that the invention may find utility in combination with other heat sources besides range gas burners 22.

While cooktop 14 includes two pairs of grates 28 positioned over two pairs of burners 22 it is contemplated that greater or fewer numbers of grates could be employed with a greater or fewer number of burners without departing from the scope of the present invention.

Figure 2:
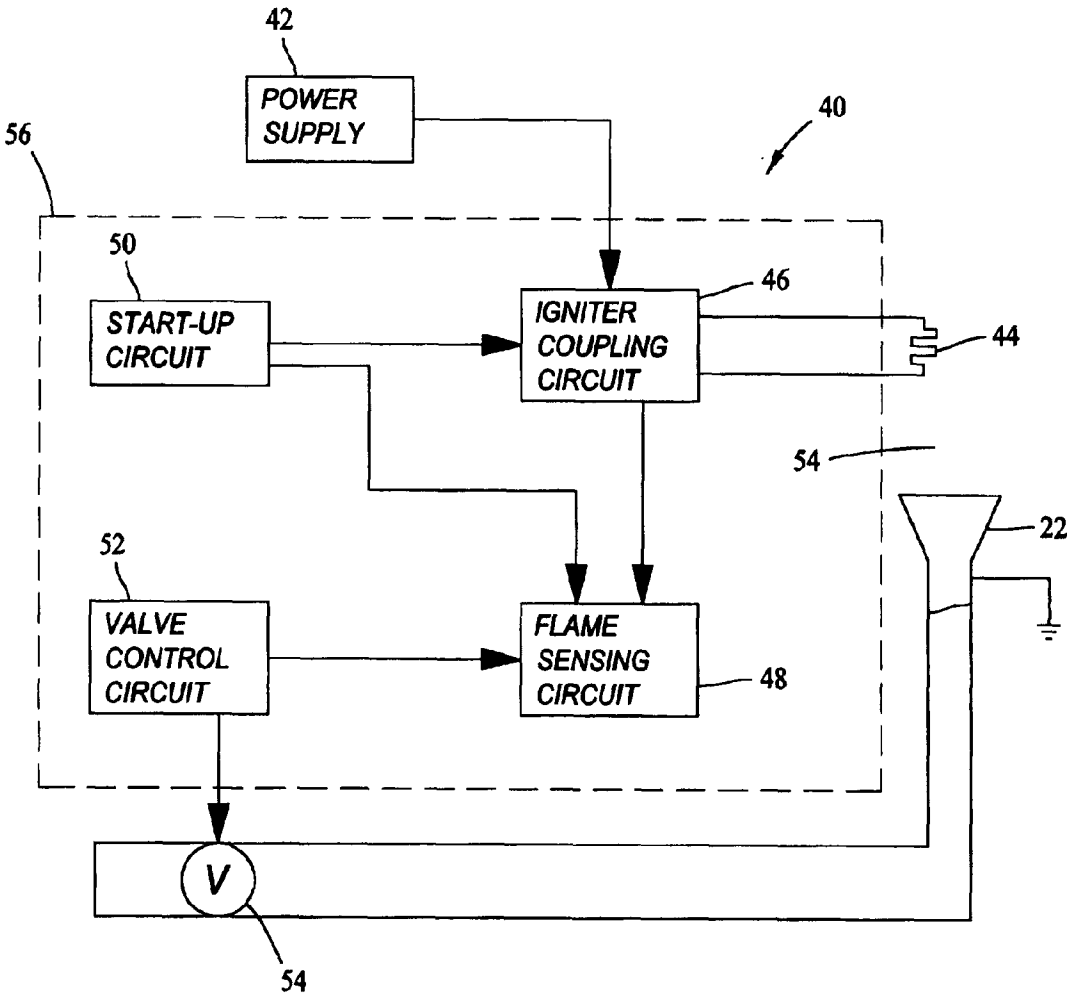
FIG. 2 is a functional schematic diagram of a fuel burner control system for the range shown in FIG. 1.

FIG. 2 is a functional schematic diagram of a fuel burner control system 40 for range 10 (shown in FIG. 1). Burner control system 40 includes a power supply 42, an igniter 44, associated igniter coupling circuitry 46, flame sensing circuitry 48, burner start-up circuitry 50, and a fuel valve control circuit 52 operatively coupled to a fuel valve 54 that delivers fuel to a selected burner 22.

In one embodiment, power supply 42 is a known alternating current power supply for appropriately driving igniter coupling circuitry 46. To ignite fuel for burner 22, igniter coupling circuitry 46 passes current to igniter 44, which in an exemplary embodiment is a resistance heating element that can ignite fuel when heated to an ignition temperature. In an alternative embodiment, igniter 44 is a known device capable of generating high voltage sparks through capacitive discharge when activated by igniter coupling circuitry 46.

Start-up circuitry 50 is selectively activated for a predetermined periods and generates heating signals to igniter coupling circuitry 46 and also for selected periods when an ignition signal is applied to flame sensing circuitry 48. In response to the heating signal, coupling circuitry 46 passes current from power supply 42 to igniter 44 at a reduced level until igniter 44 reaches an ignition state. The ignition signal from start-up circuitry 50 causes flame sensing circuitry 48 to signal valve control circuitry 52 to open fuel valve 54 that supplies fuel to burner 22. Fuel is then delivered to burner 22 and ignited by igniter 44.

Flame sensing circuitry 48 is coupled to igniter coupling circuitry 46 and detects and responds to flame rectified current passing between igniter 44 and grounded burner 22. Direct flow of current from power supply 42 to flame sensing circuitry 48 is prevented by igniter coupling circuitry such that igniter 44 may be used as both an ignition source and as an electrode for deriving flame-rectified current. Igniter 44 is positioned with respect to burner 22 to form a gap 54 therebetween. When a burner flame is present and voltage is applied across gap 54, the flame effectively functions as a diode and cuts off positive half cycles of an applied alternating current signal from the electrode/igniter 44. Thus, by monitoring current flow into grounded burner 22 across gap 54, the presence or absence of a flame is detected by flame detection circuitry and, if no flame is present, igniter 44 is again activated for reigniton of the flame.

It is believed that specific circuitry to accomplish the aforementioned functions of igniter coupling circuitry 46, flame sensing circuitry 48, start-up circuitry 50 and valve control circuitry 52 is within the purview of those in the art and furthermore is sometimes packaged in an ignition/reignition module 56 (shown in phantom in FIG. 2). One such ignition/reignition module is commercially available from Tytronics of Hendon, SA, Australia.

Figure 3:
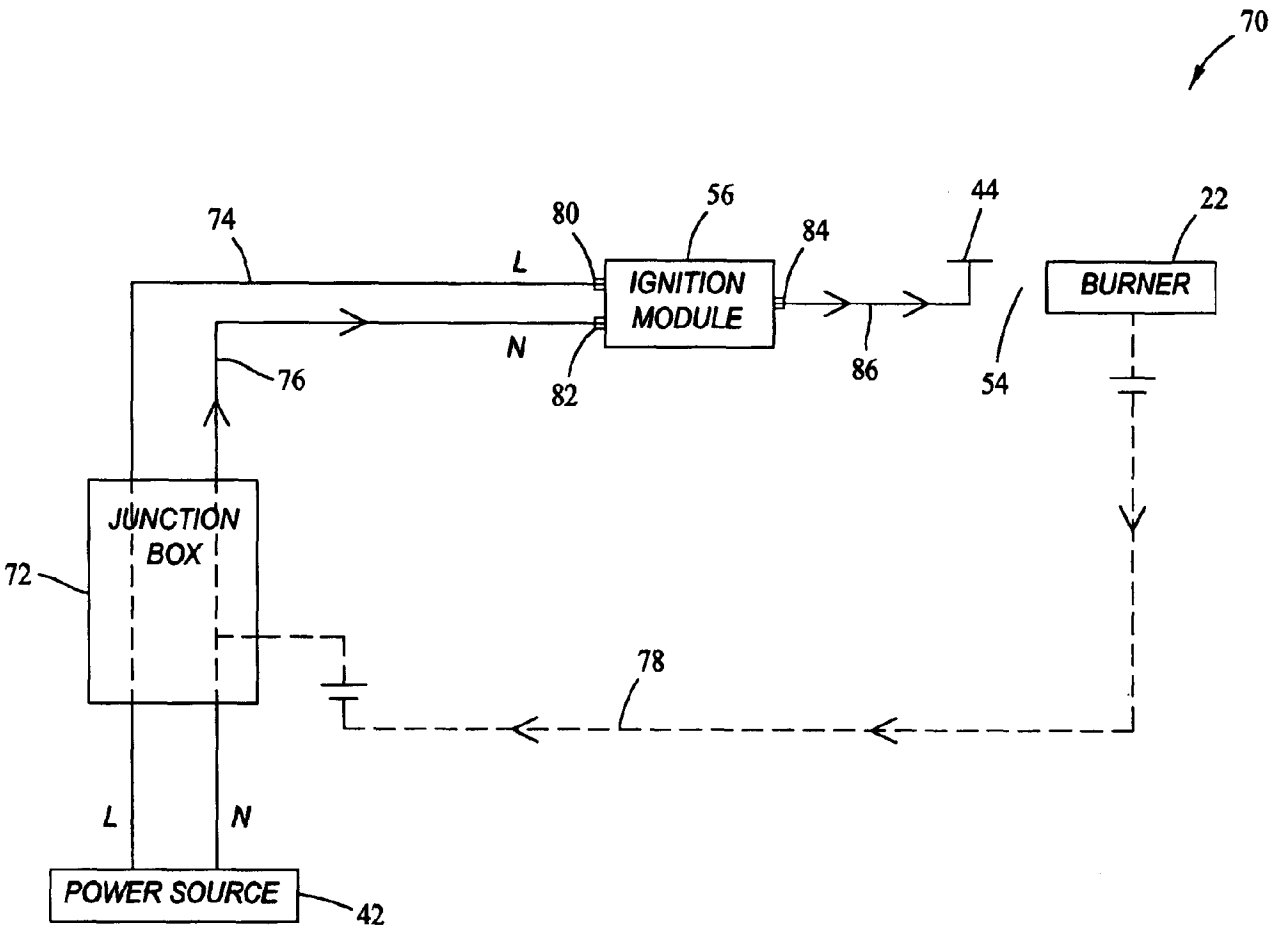
FIG. 3 PRIOR ART
FIG. 3 is a schematic block diagram of a known ignition system for the range shown in FIG. 1.

FIG. 3 is a schematic block diagram of a known ignition system 70 for range 10 (shown in FIG. 1). Ignition system 70 includes power supply 42 feeding a junction box 72 such as those commonly found in residential homes and commercial buildings to distribute power throughout a structure, ignition module 56 and burner 22.

Junction box 72 distributes power the building electrical system, which includes a line or phase conductor 74, a neutral conductor 76, and a ground conductor 78 for establishing and completing safe electrical circuits within the building. Ignition module 56 includes first and second inputs 80, 82 and an output 84 for sending signals to igniter 44. First input 80 of igniter module 80 is coupled to phase or line conductor 74, and second input 82 of ignition module 56 is coupled to neutral conductor 76 of the electrical system. Burner 22 is connected to electrical system ground conductor 78, and, when properly wired, ground conductor 78 is connected to junction box 72 and tied to neutral conductor 76 extending from junction box 72.

Junction box 72 receives power from power supply 42, and line or phase conductor 74 supplies power to ignition module 56 through first input 80. Ignition module 56 supplies power to igniter 44 through a conductor 86, and igniter 44 ignites fuel delivered to burner 22. Once ignited, the burner flame acts as a diode for flame detection circuitry of ignition module 56, and igniter functions as an electrode for passing current through the burner flame and across gap 54. The current passes through burner 22 to ground conductor 78, which is tied to neutral conductor 76 through junction box 76. Current flows through neutral conductor 76 to ignition module second input 82 for feedback control of igniter 44 in response to current signals received at ignition module second input 82, and igniter 44 is activated as necessary for reignition of the burner flame. The return path of current from burner 22 to ignition module 56 is illustrated by arrows in FIG. 3.

Under normal operation of power supply 42 and the electrical system with a properly wired junction box 72, ignition module 56 capably ignites the burner flame with igniter 44, monitors the flame thereafter, and if needed, reignites the burner flame. However, there are several conditions that can disrupt proper operation of ignition module and cause ignition module to continually activate igniter 44, which negatively affects energy efficiency and shortens a working life of ignition module 56 and/or igniter 44.

For example, it is not uncommon to encounter an improperly wired junction box 72 wherein neutral conductor 76 stemming from junction box 72 is not connected to, or tied in with, ground conductor 78. In such a case, the ignition module return current path through ground conductor 78 is broken, which, in turn causes flame detection circuitry of ignition module 56 to activate igniter 44 in response to the input signal, or lack thereof, at ignition module input 82. The broken current return path leads to false detection of an extinguished flame, and therefore ignition module 56 continuously activates igniter 44 even through a flame is present.

In addition, known ignition modules 56 are sensitive to voltage on the neutral conductor 76 at ignition module input 56. Voltages on neutral conductor 76 can desensitize flame sensing circuitry and compromise operation of ignition module 56.

Still further, and as appreciated by those in the art, line or phase conductor 74 and neutral conductor 76 are sometimes reversed by power supply 42. This reversal can also lead to erroneous detection of an extinguished flame and cause ignition module to continuously excite igniter 44.

Figure 4:
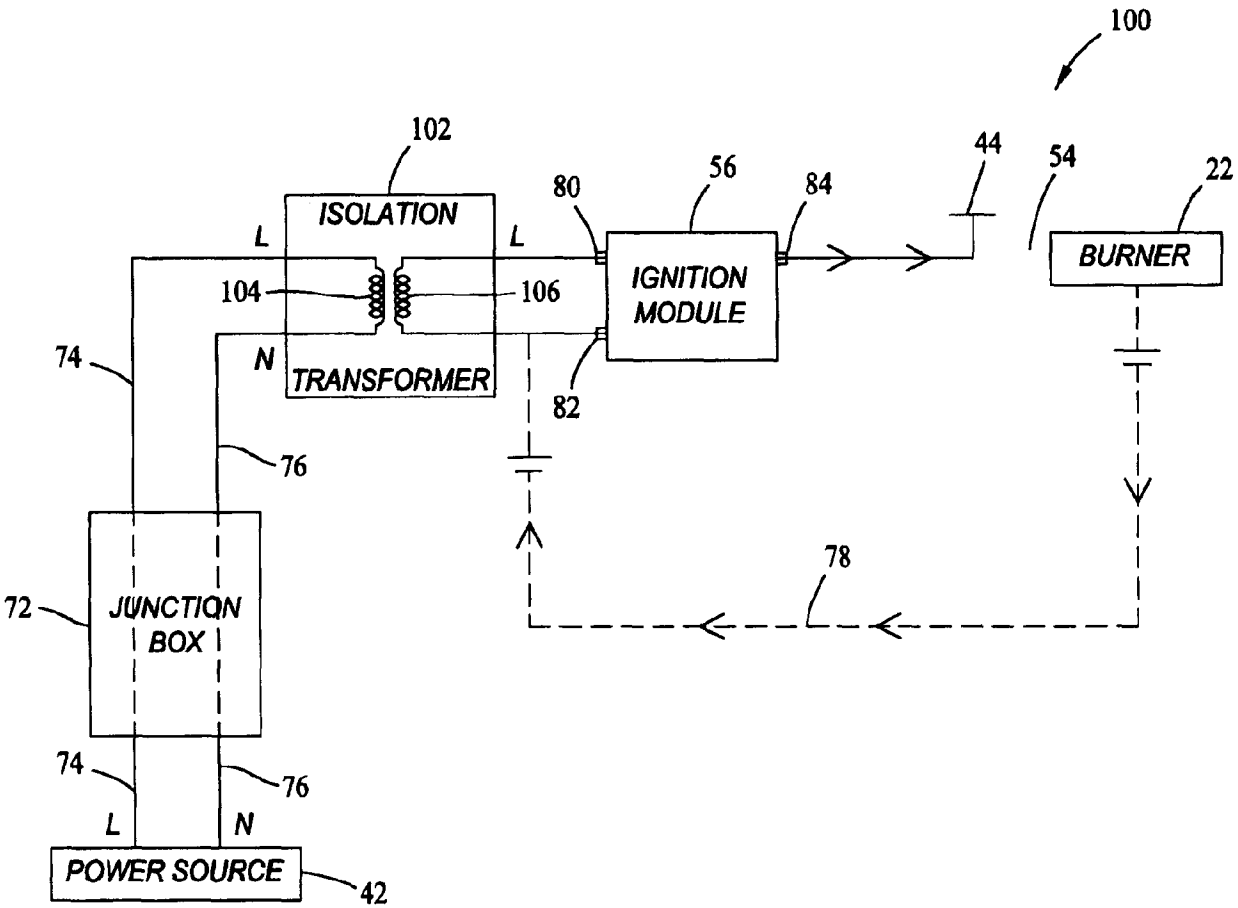
FIG. 4 is a schematic block diagram of an ignition system for the range shown in FIG. 1 according to the present invention.

FIG. 4 is a schematic block diagram of an ignition system 100 according to the present invention that may be used with, for example, range 10 (shown in FIG. 1) while avoiding the disadvantages of ignition system 70 (shown in FIG. 3). Like components of ignitions systems 70 and 100 are indicated with like reference characters in FIGS. 3 and 4).

Ignition system 100 includes an isolation transformer 102 connected between junction box 72 and ignition module 56, as such, ignition module is isolated from power source 42, and reversal of line or phase conductor 74 and neutral conductor 76 is without effect on ignition module 56. Isolation transformer 102 is a known device including a primary winding 104 and a secondary winding 106, and in an exemplary embodiment, primary winding 104 and secondary winding 106 each include approximately the same number of turns so that power output of transformer secondary winding 106 is approximately equal to the power input of primary winding 104. Primary winding 104 is connected to line or phase conductor 74 and neutral conductor 76 at ignition module inputs 80, 82.

Still further, and, unlike known ignition systems, ignition system 100 includes transformer secondary winding 106 connected to ground conductor 78. Ignition module second input 82 is also connected to ground conductor 78. As such, when the burner flame is ignited by igniter 44, igniter 44 functions as an electrode for passing current through gap 54 to grounded burner 22. A return current path, as illustrated by the arrows in FIG. 4, is therefore created from burner 22 to ignition module input 82 through ground conductor 78. Operation of ignition module 56 is thus substantially unaffected by wiring issues present at junction box 72, and more specifically, operation of ignition module 56 is not dependent upon neutral conductor 76 and ground conductor 78. Thus, ignition module operates correctly despite improper wiring of junction box 72, and flame sensing circuitry of ignition module 56 does not falsely detect an extinguished burner flame that triggers continuous excitation of igniter 44 by ignition module 56.

Additionally, and further unlike known ignition systems, because ignition module second input 82 is connected to ground, voltages at ignition module second input 82 that may desensitize flame detection circuitry of ignition module 56 are avoided.

An ignition system 100 is therefore provided that avoids line and neutral conductor reversal, avoids sensitivity to voltages of the neutral conductor, and operates substantially independently from junction box wiring issues.

While the invention has been described in terms of various specific embodiments, those skilled in the art will recognize that the invention can be practiced with modification within the spirit and scope of the claims.

What is claimed is:

1. A method for installing an ignition module for a flame burner to an electrical system, the electrical system including a phase conductor, a neutral conductor, an isolation transformer, and the ignition module, the ignition module including first and second inputs and a single output, said method comprising:

coupling the phase conductor and neutral conductor to a primary winding of the isolation transformer;

connecting the electrically isolated phase conductor from the isolation transformer to the first input of the ignition module;

connecting the electrically isolated neutral conductor from the isolation transformer to the second input of the ignition module;

connecting a ground conductor between the electrically isolated neutral conductor and a burner;

creating a return path for passing a current via a flame output from the burner and via the ground conductor to the electrically isolated neutral conductor; and connecting the single output to an igniter.

2. A method in accordance with claim 1 wherein the transformer includes a secondary winding, said method further comprising connecting the secondary winding to the first input of the ignition module and to the ground conductor.

3. A method in accordance with claim 2, the transformer including a primary winding, said method further comprising connecting the primary winding to the phase conductor and the neutral conductor.

4. A method in accordance with claim 1, the electrical system including a junction box, said method further comprising connecting the isolation transformer between the junction box and the ignition module.

5. A method for installing an ignition module for a gas-fired burner to an isolation transformer of an electrical system the isolation transformer including a primary winding and a secondary winding, the secondary winding coupled to an electrically isolated neutral conductor, the electrical system including a phase conductor, a neutral conductor and a ground conductor, the burner connected to the ground conductor, the ignition module including first and second inputs and at least one output, said method comprising:

connecting the transformer secondary winding to the first input of the ignition module;

connecting the transformer secondary winding to the ground conductor;

connecting the second input of the ignition module to the ground conductor; and creating a return path for passing a current via a flame output from the burner and via the ground conductor to the electrically isolated neutral conductor.

6. A method in accordance with claim 5 further comprising connecting the primary winding to the phase conductor and the neutral conductor.

7. An ignition system comprising:

a burner for producing a flame;

a power supply;

an electrical system comprising a ground conductor coupled to said burner;

an ignition module comprising a first input, a second input, and a single output, said output operatively coupled to said burner, one of said inputs coupled to said ground conductor, the other of said inputs coupled to said power supply;

an isolation transformer connected in series between said power supply and said ignition module;

an electrically isolated neutral conductor coupled to said ignition module and said isolation transformer; wherein said ground conductor configured to provide a return path that passes a current from a flame output from said burner to said electrically isolated neutral conductor.

8. An ignition system in accordance with claim 7, said isolation transformer comprising a secondary winding, said secondary winding connected to said first input of said ignition module and connected to said ground conductor.

9. An ignition system in accordance with claim 8, said transformer comprising a primary winding, said electrical system further comprising a phase conductor and a neutral conductor, said primary winding coupled to said phase conductor and to said neutral conductor.

10. An ignition system comprising:

a gas burner;

an AC power supply comprising a phase conductor and neutral conductor;

an electrical system comprising a ground conductor coupled to said burner;

an isolated neutral conductor;

an isolation transformer comprising a primary winding and a secondary winding, said primary winding connected to said phase conductor and to said neutral conductor, said secondary winding coupled to an isolated phase conductor and said isolated neutral conductor; and an ignition module comprising a first input, a second input, and an output, said output electrically connected to an igniter, said ignition module coupled in series with said isolation transformer, wherein one of said inputs coupled to said isolated neutral conductor, the other of said inputs coupled to said isolated phase conductor, said ground conductor coupled to said isolated neutral conductor between said ignition module and said isolation transformer, and said ground conductor configured to provide a return path that passes a current from a flame output from said burner to said isolated neutral conductor.

11. An ignition system in accordance with claim 10, said secondary winding further coupled to said ground conductor.

* * * * *

UNITED STATES PATENT AND TRADEMARK OFFICE

CERTIFICATE OF CORRECTION

PATENT NO. : 6,923,640 B2
APPLICATION NO. : 09/682622
DATED : August 2, 2005
INVENTOR(S) : Daniel Canon It is certified that error appears in the above-identified patent and that said Letters Patent is hereby corrected as shown below:

Column 5, line 67, delete “system the” and insert therefor -- system, the --.

Signed and Sealed this

Ninth Day of January, 2007

JON W. DUDAS
*Director of the United States Patent and Trademark Office*